US006244204B1

(12) United States Patent
Weyman

(10) Patent No.: US 6,244,204 B1
(45) Date of Patent: Jun. 12, 2001

(54) FAIRING FOR A TOWED CABLE

(75) Inventor: H. Nicolas Weyman, deceased, late of Ontario (CA), by Heather Weyman, legal representative

(73) Assignee: Odim Holding ASA (NO)

( * ) Notice: Subject to any disclaimer, the term of this patent is extended or adjusted under 35 U.S.C. 154(b) by 0 days.

(21) Appl. No.: 09/427,940

(22) Filed: Oct. 27, 1999

(30) Foreign Application Priority Data

Nov. 3, 1998 (NO) ..... 5122/98

(51) Int. Cl.[7] ..... F15D 1/10
(52) U.S. Cl. ..... 114/243
(58) Field of Search ..... 114/243; 405/211, 405/212, 195.1, 216

(56) References Cited

U.S. PATENT DOCUMENTS

| | | | | |
|---|---|---|---|---|
| 1,104,254 | * | 7/1914 | Eddelbuttel-Reimers | 114/243 |
| 3,241,513 | | 3/1966 | Rather . | |
| 3,454,051 | * | 7/1969 | Goepfert et al. | 114/243 |
| 3,712,261 | * | 1/1973 | McLelland et al. | 114/243 |
| 3,899,991 | | 8/1975 | Chatten . | |
| 4,075,967 | | 2/1978 | Silvey . | |
| 4,365,567 | | 12/1982 | Kuhar . | |
| 4,567,841 | | 2/1986 | Hale . | |
| 4,700,651 | | 10/1987 | Hale . | |
| 4,756,269 | * | 7/1988 | Holcombe et al. | 114/243 |
| 5,410,979 | | 5/1995 | Allen . | |

* cited by examiner

*Primary Examiner*—Stephen Avila
(74) *Attorney, Agent, or Firm*—Nixon & Vanderhye PC

(57) ABSTRACT

A fairing for a towed cable is described that comprises a pliable material folded over the cable and stitched together, to give a substantially drop shaped cross section, wherein the flexible material is segmented into individual sections in the longitudinal direction of the cable, wherein each section being fastened to a free-rotating, but along the cable non-sliding, fastening device and wherein each section independent of each other may rotate around the cable together with its is fastening device. A faired tow cable is also described that has a fairing comprising a pliable material folded over the cable and stitched together to give a substantially drop shaped cross section, wherein the fairing is segmented into individual sections where each section at its upstream end is fastened to a free-rotating, but non-sliding, fastening device attached to the cable and wherein each section independent of each other may rotate around the cable together with its fastening device. An anti stacking ring and a method for the production of an anti stacking ring are also described.

8 Claims, 4 Drawing Sheets

FAIRING FOR A TOWED CABLE

FIELD OF THE INVENTION

This invention relates to an improved fairing and fairing assemblies for underwater cables, particularly towed cables, to reduce drag resistance compared with a unfaired cable, when the cable is moving relative to the water. The invention also relates to a faired cable provided with the improved fairing.

BACKGROUND OF THE INVENTION

It is well known that faired cables gives less resistance to motion, or cable drag, of a cable that is moving through the water.

The marine seismic exploration companies are attempting to put more and more cables into the water to improve efficiency, performance and the area explorated per unit of time. Drag reduction and elimination of cable strumming becomes therefor all-important.

Prior art fairings ranges from ribbon or hairy (close-knit weave around cable, with tufts or strings) fairings, to "flag" style triangular-shaped material (typically sewn canvas or similar), to hydrofoil-shaped rigid segments along the cable. The ribbons and hairy fairings have the advantage of being easy to handle and withstand wrapping in multiple layers of cable on a winch drum, and then retain its original form when deployed. The primary objective from using these types of fairings is to reduce cable vibration, or strumming; however, their hydrodynamic performance as it relates to actual drag reduction is limited.

Improved hydrodynamic performance is possible with a drop shaped fairing. For example U.S. Pat. No. 5,410,979 describes non-rotary drop shaped fairing made of metal to reduce vibration on marine tubular pipes (e.g. at an offshore rig). This fairing is acceptable on permanent pipes where the direction of flow does not change but it is not satisfactory on a towed cables.

Hydrofoil-shaped rotary fairings are normally made of relatively hard plastic or rubber-like materials. Some of the hard fairings must be stripped away form the cable before the cable is wrapped on a drum. One solution for rapid and relatively easy wrapping and stripping off a cable is described in U.S. Pat. No. 4,365,567. However this method is not fully acceptable for towed cables that is wrapped on a drum when not in use.

To give some flexibility to hydrofoil-shaped fairing to make is possible to wrap the faired cable on a winch drum, U.S. Pat. No. 4,567,841 and U.S. Pat. No. 4,700,651 describes fairing segmented into short interconnected sections. A faired cable according to those solutions may be wrapped on a one layer drum and is therefor acceptable for short cables. For long cables (for example, in excess of 250 meters) as used for seismic systems, however, this solution is not fully acceptable as the hard fairing are too vulnerable for damage if wrapped up on an multiple layer drum.

Prior art fairings does also include fairings made of pliable material folded around the cable and stitched together to make a drop shaped fairing. A fairing of this kind may be wrapped on a drum without breaking the fairing. However, the fairing does often fail to resume the drop shape as it is twisted around the cable. On long cables the pliable material is additionally subject to an enormous drag that can tear the material. An additional problem is that the fairings made of pliable material is what is called <<ballooning>> resulting from the fairing <<puffing>> out loosing its hydrodynamic shape.

There is, therefor, still a need for a fairing that is pliable enough to withstand being wrapped in multiple layers on a winch drum and then come back to its original hydrodynamic profile when deployed.

SUMMARY OF THE INVENTION

A first aspect of the invention relates to a airing for a towed cable comprising a pliable material folded over the cable and stitched together to give a substantially drop shaped cross section, wherein the flexible material is segmented into individual sections in the longitudinal direction of the cable, that each section at its upstream end is fastened to a free-rotating, but along the cable non-sliding fastening devise and that each section independent of each other may rotate around the cable together with its is fastening devise.

Preferably the fastening devise is prevented from sliding along the cable by an anti stacking ring fixed to the cable at the downstream end of the fastening means.

It is also preferred that the fastening devise is prevented from sliding along the cable by an anti stacking ring fixed to the cable and wherein the anti stacking ring is placed in a cut out slot it the nose section of the fastening devise.

Preferrably the fastening devise has a substantially drop shaped cross section.

It is also preferred that a bridge is stitched across the cross section of the pliable part of the fairing to prevent the fairing from ballooning during towing.

A second aspect of the invention relates to a faired tow cable provided with a fairing comprising a pliable material folded over the cable and stitched together to give a substantially drop shaped cross section, wherein the fairing is segmented into individual sections where each section at its upstream end is fastened to a free-rotating, but non-sliding fastening devise attached to the cable and that each section independent of each other may rotate around the cable together with its fastening devise.

A third aspect of the invention relates to an anti stacking ring for a towed cable, wherein the ring is made of a glassfibre tape coated with water activated polyurethane resins, where the ring is moulded in situ onto the cable.

A fouth aspect of the invention relates to a method for the production of a anti stacking ring for a towed cable, said method comprises the following steps:

a) cleaning and rubbing of a segment of the cable;

b) attaching two clamps in a distance to each other equal to the width of the antistacking ring;

c) soaking of a glassfibre tape coated with polyurethane resins that are activated by water;

d) wrapping the tape around the cable between the clamps;

e) smoothening of the ring surface;

f) removing of the clamps.

The fairing according to the invention is primarily for use on seismic lead-in tow cables.

It also has the potential to be used on ROV and other navy and oceanographic tow cables where it is important that the faired cable can be repeatately wrapped on a winch drum without damaging the fairing.

DETAILED DESCRIPTION OF THE PREFERRED EMBODIMENTS

In the description and claims the "upstream direction" is the direction from a given point on the towed cable towards the towing vessel and the "downstream direction" is the opposite direction.

The fairing according to the invention is a soft, pliable fairing which withstands being wrapped in multiple layers on a winch drum and then come back to its original hydrodynamic profile when deployed into the water.

The major part of the fairing is made from a pliable material, preferably a special Armid material, typically used as conveyor belt in conveyor-type systems.

The pliable material is die cut in a into a belt 5 that is folded over, mated at the tail edges, and stitched together using a specialised, heavy-duty sewing machine and accessory equipment with a seam 6 parallel to the edge of the belt 5 to make an elongated hose with drop shaped, or hydrodynamic cross section.

Figure 1:
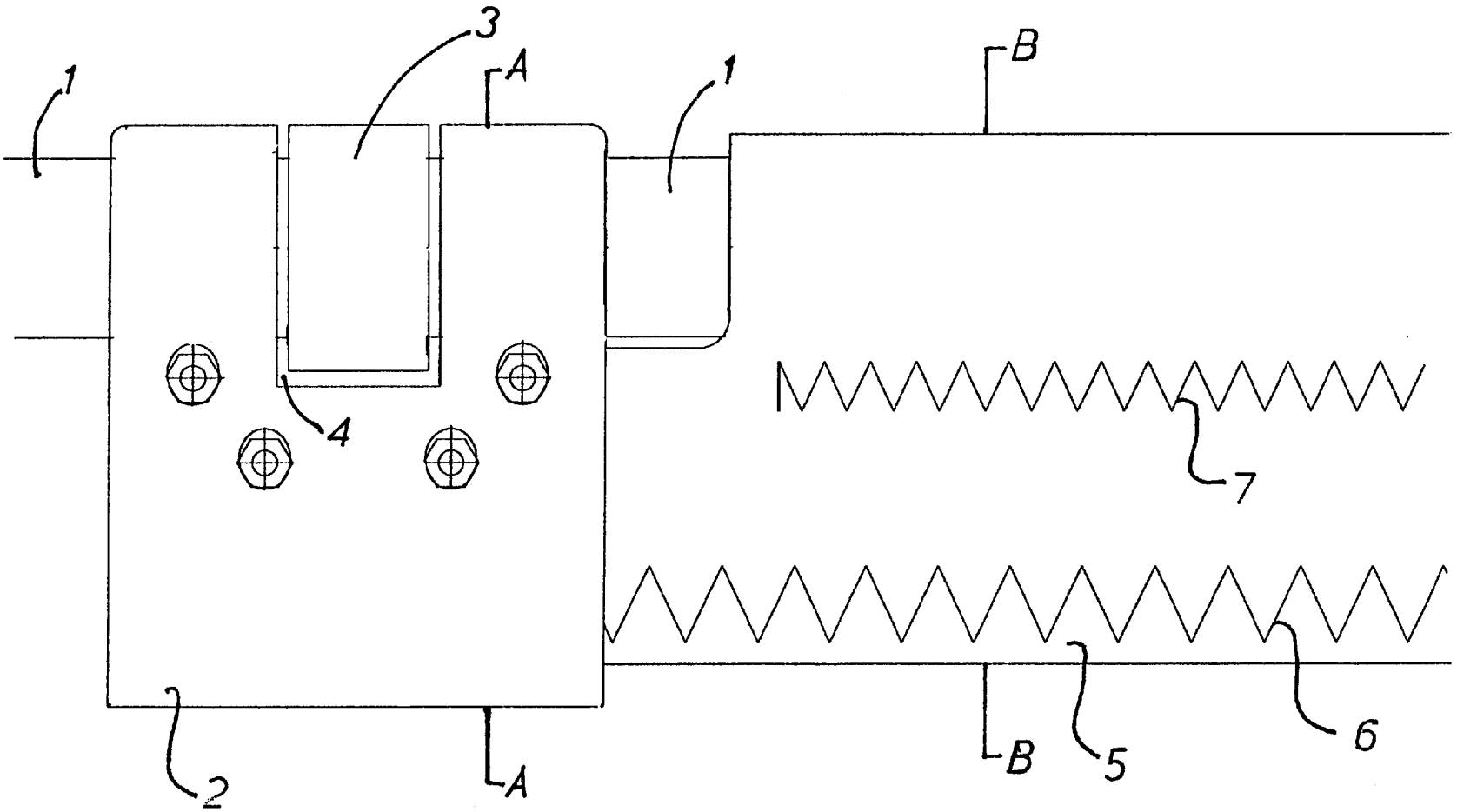
FIG. 1 is a view of a section of the fairing according to the invention.
Figure 2:
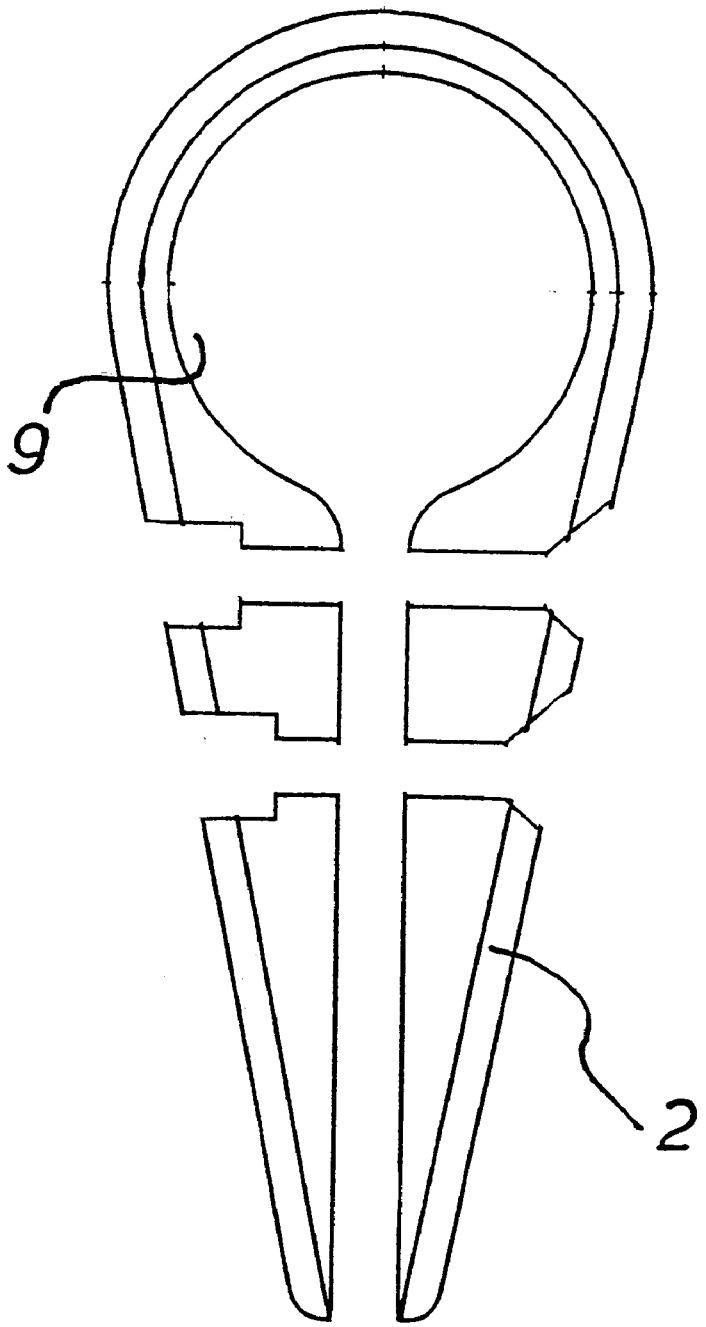
FIG. 2 is the cross section A—A in FIG. 1.
Figure 3:
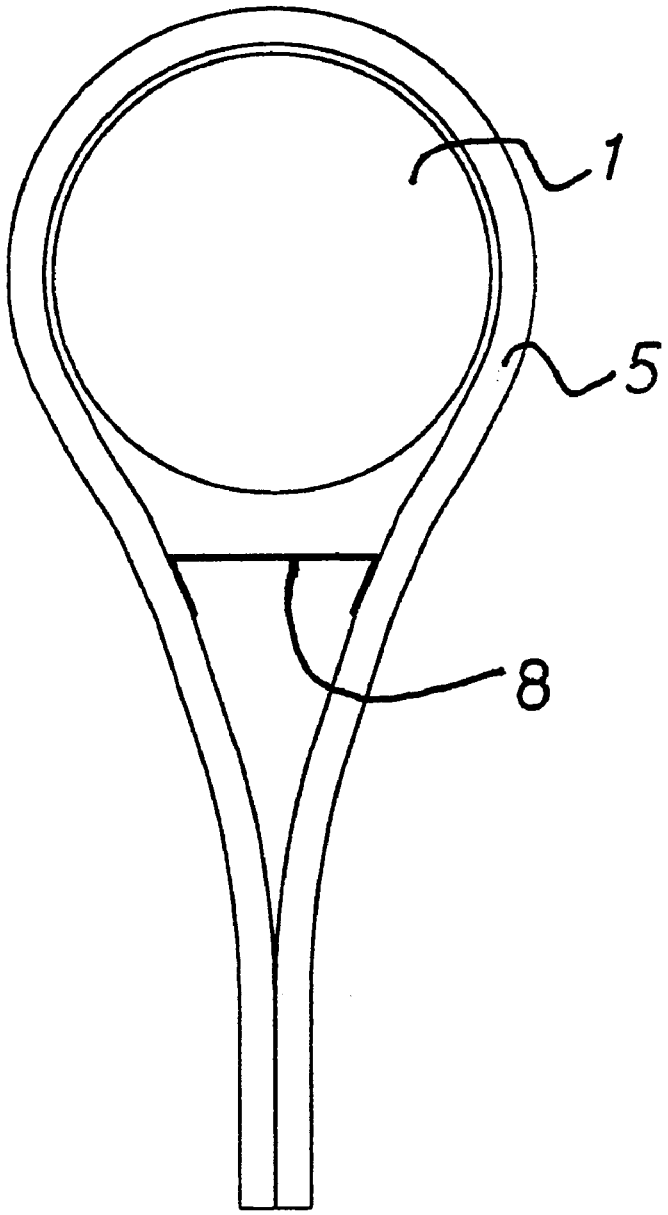
FIG. 3 is the cross section B—B in FIG. 1.

To maintain the hydrodynamic cross section of the fairing and to prevent what is called "ballooning" (i.e., the fairing "puffs" out and loses its hydrodynamic profile), a strip of strong fabric (e.g. Dacron or Kevlar sailcloth), is fastened, preferably by stitching, across the inner space of the fairing as indicated in FIG. 3.

Figure 4:
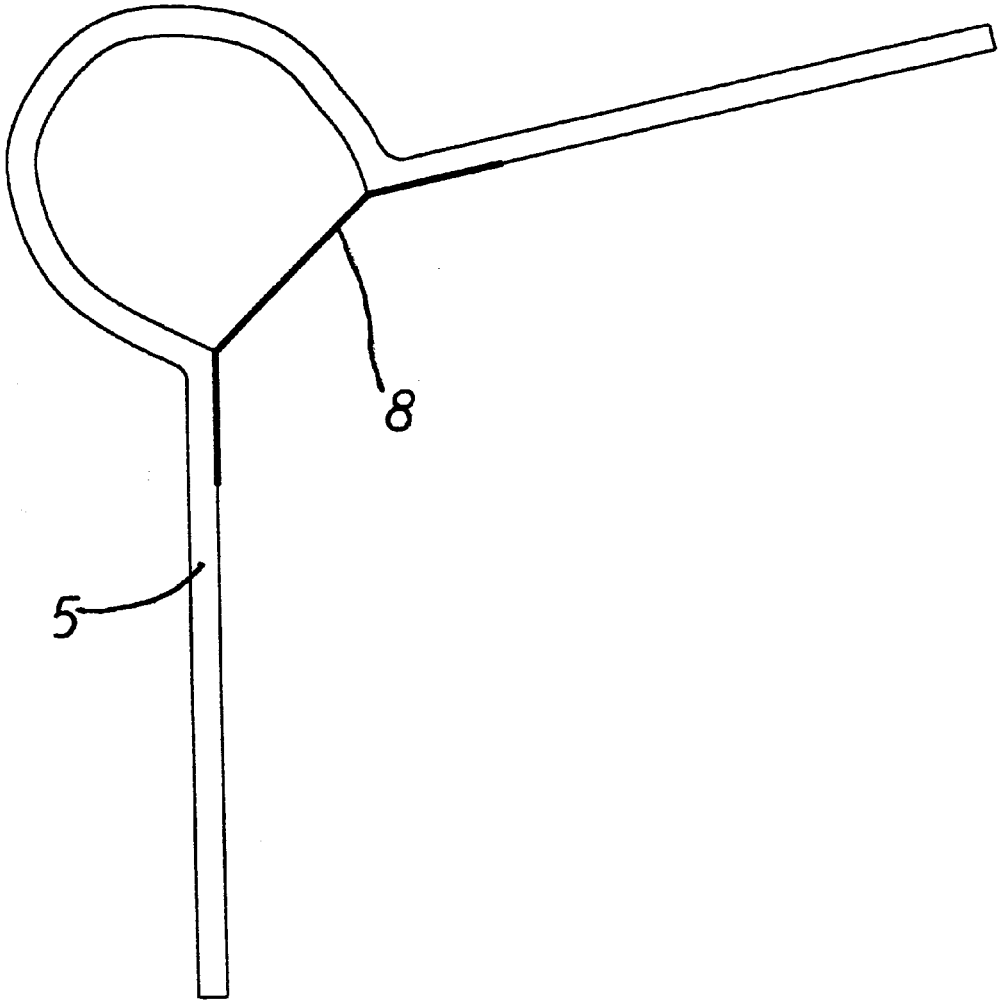
FIG. 4 is a cross section of the fairing under production

The bridge 8 must be fastened onto the belt 5 before the seam 6 is made as indicated in FIG. 4 which shows the fairing after the bridge has been stitched to the belt and before the seam 6 is made.

To break the hydrodynamic forces into manageable segments along the cable and avoid that the fairing is twisted around the cable while towing, the fairing is sectioned into shorter independent sections of pliable material, typical 2 to 10 m, preferably about 5 meter.

To avoid that the pliable fairings "jam" into each other, the King Fairing 2 is prevented from sliding along the cable by means of an antistacking ring (ASR) 3 that is attached to the cable. In its most simple embodiment the ASR 3 is situated on the downstream end of the King Fairing 2 to prevent it from sliding in the downstream direction only. However in the most preferable embodiment the King Fairing 2 has a cut-out slot in its nose section for ASR 3 to prevent the King Fairing 2 from sliding both in the downstream and upstream direction of the cable 1.

The ASR 3 allows the King Fairing 2 to rotate freely around the cable 1 without sliding along the cable 1. This allows each section of the fairing to free-align to the water flow, yet still be practically continuous over the entire cable length.

The ASR 3 must be positively attached the cable 1 and withstand the forces without slipping. For seismic cables the ASR's 2 are fixed to the outer layer of the cable using one of two methods depending on the type of the cable outer layer (i.e., either steel armoured outer layer, or with a high density polyethylene—HDPE—jacket cover).

For bare armoured cables, the ASR is a welded and then crimped on ring made from 316 stainless steel. A high tensile strength polyurethane underlay material is inserted between the steel ring and cable, and the ring and an aluminium bronze friction layer is applied to both the outer cable armour and the inner surface of the steel ring.

For HDPE jacketed cables, a new anti stacking ring capable to withstand the forces during normal use without slipping, has been developed. The preferred material for preparation of an ASR is a knitted fibreglass tape, coated with polyurethane resins that are activated by water.

The following method is developed for production of the new anti stacking ring (ASR): First the HDPE cable jacket is cleaned and roughened. Two ring moulding clamps are then attached to the cable in a distance from each other equal to the with of the ASR to be produced. The knitted glass fibre tape is then soaked with water before it is rapidly wrapped around the cable between the clamps. The end of the tape roll is then smoothened into a ring surface with gloves wetted with water until the surface is no longer tacky.

The cured anti stacking ring is strong enough to withstand the typical forces during the towing of the cable.

What is claimed is:

1. A fairing for a towed cable comprising a pliable member folded over the cable and stitched together to give a substantially drop shaped cross section, wherein the flexible material is segmented into individual sections in the longitudinal direction of the cable, wherein each section at its upstream end is fastened to a free-rotating, but along the cable non-sliding fastening device, and wherein each section independent of each other may rotate around the cable together with its fastening device, and wherein a bridge is stitched across the cross section of the pliable part of the fairing to prevent the fairing from ballooning during towing.

2. A method for the production of a anti stacking ring for a towed cable, characterised in that the method comprises the following steps:

a) cleaning and rubbing of a segment of the cable;

b) attaching two clamps in a distance to each other equal to the width of the antistacking ring;

c) soaking of a glassfibre tape coated with polyurethane resins that are activated by water;

d) wrapping the tape around the cable between the clamps;

e) smoothening of the ring surface; and f) removing of the clamps.

3. A fairing for a towed cable comprising:

a plurality of individual fairing sections of flexible material, each said fairing section being folded over the cable and stitched to itself to define a substantially drop-shaped cross-section, said fairing sections being disposed at spaced locations along the length of the cable, a plurality of fastening devices, at least one longitudinal end of each said section being secured to a respective fastening device, each said fastening device being substantially immovable axially of the cable, but being freely rotatable about the cable, whereby each said fairing section is rotatable around the cable together with the fastening device secured thereto, independent of the remaining fairing sections.

4. The fairing according to claim 3, wherein the fastening device comprises an anti-stacking ring fixed to the cable and a free-rotating segment, said free-rotating segment being secured to said respective fairing section and being freely rotatable relative to said anti-stacking ring and to said cable.

5. The fairing according to claim 4, wherein a cutout slot is defined in the free-rotating section of the fastening device and the anti-stacking ring is disposed in said cutout slot.

6. The fairing according to claim 3, wherein the fastening device has a substantially drop-shaped cross-section.

7. The fairing according to claim 4, wherein the stacking ring is made of a glass fiber tape coated with water activated polyurethane resin and wherein the ring is molded onto the cable.

8. A fairing towed cable provided with a fairing, the fairing comprising:

a plurality of individual fairing sections of flexible material, each said fairing section being folded over the cable and stitched to itself to define a substantially drop-shaped cross-section, said fairing sections being disposed at spaced locations along the length of the cable, a plurality of fastening devices, at least one longitudinal end of each said section being secured to a respective fastening device, each said fastening device being substantially immovable axially of the cable, but being freely rotatable about the cable, whereby each said fairing section is rotatable around the cable together with the fastening device secured thereto, independent of the remaining fairing sections.

* * * * *